US006550268B2

(12) United States Patent
Lee et al.

(10) Patent No.: US 6,550,268 B2
(45) Date of Patent: Apr. 22, 2003

(54) COOLING AIR PASSAGE APPARATUS OF REFRIGERATOR

(75) Inventors: Jae Hee Lee, Changwon (KR); Young Seok Choi, Changwon (KR); Byung Gyu Kang, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/987,663

(22) Filed: Nov. 15, 2001

(65) Prior Publication Data

US 2002/0059805 A1 May 23, 2002

(30) Foreign Application Priority Data

Nov. 22, 2000 (KR) ..... 2000-69527
Dec. 4, 2000 (KR) ..... 2000-73115
Dec. 30, 2000 (KR) ..... 2000-87402

(51) Int. Cl.[7] ..... F25D 17/04
(52) U.S. Cl. ..... 62/407; 62/413; 62/414
(58) Field of Search ..... 62/404, 407, 413, 62/414, 419

(56) References Cited

U.S. PATENT DOCUMENTS 5,584,191 A * 12/1996 Kwon ..... 62/255
5,687,580 A * 11/1997 Jeong et al. ..... 62/186
5,896,752 A * 4/1999 Park ..... 62/186
5,921,104 A * 7/1999 Chang ..... 62/407
5,960,641 A * 10/1999 Kim et al. ..... 62/404
5,979,174 A * 11/1999 Kim et al. ..... 62/404
5,992,164 A * 11/1999 Kim ..... 62/186
6,041,606 A * 3/2000 Kim ..... 62/186
6,151,908 A * 11/2000 Graaff ..... 62/371
6,381,982 B1 * 5/2002 Kim ..... 62/407

* cited by examiner

*Primary Examiner*—William E. Tapolcai
*Assistant Examiner*—Mohammad M. Ali
(74) *Attorney, Agent, or Firm*—Fleshner & Kim, LLP

(57) ABSTRACT

A cooling air passage apparatus of a refrigerator includes: a left cooling air duct installed having a plurality of cooling air discharge holes in the vertical direction at the left side of the opened marginal portion of an inner case forming a storage chamber, and discharging cooling air from the left side of the storage chamber toward a refrigerator door; a right cooling air duct installed having a plurality of cooling air discharge holes in the vertical direction at the right side of the opened marginal portion of the inner case, and discharging cooling air from the right side of the storage chamber toward the refrigerator door; a ventilating unit for ventilating cooling air generated from a freezing system to the storage chamber; and a diverging unit for diverging and guiding cooling air ventilated by the ventilating unit to the left cooling air duct and the right cooling air duct.

8 Claims, 8 Drawing Sheets

COOLING AIR PASSAGE APPARATUS OF REFRIGERATOR

BACKGROUND OF THE INVENTION

1. Field of the Invention

The present invention relates to a refrigerator, and more particularly, to a cooling air passage apparatus of a refrigerator that is capable of uniformly and quickly supplying cooling air into a storage space of a refrigerator.

2. Description of the Background Art

In general, in order to keep foodstuffs in a fresh state for a long period in a refrigerator, it is requisite to uniformly maintain the internal temperature of a freezing chamber and a cooling chamber. For this purpose, a cooling air discharge hole is formed at a door side of the refrigerator, thereby changing a cooling air passage.

FIG. 1 is a front view showing a state that a door of the refrigerator is opened in accordance with a conventional art, FIG. 2 is a sectional view taken along line 'A—A' of FIG. 1, and FIG. 3 is a vertical-sectional view showing a cooling air passage of the refrigerator in accordance with the conventional art.

The conventional refrigerator includes an outer case 102 forming an outward appearance of a refrigerator, an inner case 104 forming a storage chamber (S) for storing foodstuffs, a door 106 disposed to be opened and closed at the opened front side of the inner case 104, a freezing system (not shown) disposed at one side of the inner case 104, for cooling air inside the storage chamber (S), and a cooling air passage for supplying cooling air generated by the freezing system to the storage chamber (S).

The inner case 104 forms the storage chamber (S) for storing foodstuffs, in which the storage space is partitioned in the horizontal direction to install shelves 108 for receiving foodstuffs, and an enlarged portion 112 is formed enlarged slantingly in the circumferential direction of the opened portion of the inner case 104.

The door 106 is made of an insulating material to prevent heat exchange with outside, forms the storage chamber (S) together with the inner case 104.

At the inner marginal circumference, a gasket 114 made of rubber is installed to prevent cooling air leakage by covering the storage chamber (S) when the door 106 is closed.

A door liner 116 to be inserted into the enlarged portion 11 is protruded at the inner circumference of the gasket 114. A door basket 118 is inserted in the door liner 116, and is utilized as a space for receiving foodstuffs.

When the door 106 is closed, the door liner 116 is inserted into the enlarged portion 112, and at this time, an interval 'A' is formed between the door liner 116 and the enlarged portion 11.

The freezing system includes a compressor, a condenser, a capillary tube, an evaporator 120 and a ventilating fan 122, and so forth, so that while passing the compressor, the condenser and the capillary tube, a coolant becomes a two-phase state in a mixture of a liquid and a gas and sucked into the evaporator 120.

And then, as the coolant passes the evaporator, it is completely evaporated, taking heat around it.

Thanks to the evaporation action of the coolant, the air around the evaporator is cooled and supplied through the cooling air passage to the storage chamber by the ventilating fan 122.

The cooling air passage includes a cooling air discharge duct 124 installed in the vertical direction at the rear side of the inner case 112, for supplying cooling air; a plurality of cooling air discharge holes 126 formed in the longitudinal direction of the cooling air discharge duct 124, for supplying cooling air to every storage space partitioned by the shelves 108; and a suction duct 128 installed at an the upper side of the storage chamber (S), through which air circulated the storage chamber and completed a cooling action flows toward the evaporator 120.

As stated above, in the conventional refrigerator, when the freezing system is driven, the air inside the storage chamber (S) is cooled while passing the evaporator according to rotation of the ventilating fan 122, and the cooled air flows to the discharge duct 124 and is discharged through each cooling discharge hole 126 into the storage chamber.

At this time, speaking of the cooling air flow, a cooled air flows from the upper portion of the storage space where the cooling air discharge hole 126 is installed to the lower portion and warm air at the lower portion goes up to the empty space where the cooled air has existed, thereby forming a convection current.

That is, the cooling air discharged through the cooling air discharge hole 126 maintains foodstuff at a lower temperature in the storage chamber by the convection current within the storage space, and flows into the evaporator 120 through the suction duct 128.

However, as for the cooling air passage of the refrigerator of the conventional art, since the cooling air discharge hole is formed at the rear side of the cooling chamber, cooling air is concentrated to the rear side and the central portion of the cooling chamber in the vicinity of the cooling air discharge hole. Thus, foodstuffs near the cooling air discharge hole receives much cooling air and over-cooled, while foodstuffs kept near the door, far from the cooling air discharge hole less affected by the cooling air relatively and weakly cooled.

Namely, the internal temperature of the storage chamber has a big deviation according to the distance from the cooling air discharge hole, causing a problem that the temperature distribution of the storage chamber is not uniform.

In addition, in the summer season where the refrigerator is frequently opened, it is difficult to quickly cope with a rise in temperature as the refrigerator door is opened and closed.

Besides, the cooling air directing toward the door is partly introduced into a space between the door liner and the enlarged portion, contacting around the gasket. At this time, since the gasket is made of rubber, a thermal insulation efficiency is not good between the inner side and the outer side of the storage chamber. Then, air around the gasket is changed to a high-temperature air, having a bad influence to the cooling inside the storage chamber.

SUMMARY OF THE INVENTION

Therefore, an object of the present invention is to provide a cooling air passage apparatus of a refrigerator that is capable of uniformly maintaining a temperature distribution of a storage chamber by improving a cooling air passage in such a manner that cooling air can be evenly and quickly supplied to every part of the storage chamber, and capable of quickly cooling a load when the load is inputted into the storage chamber.

Another object of the present invention is to provide a cooling air passage apparatus of a refrigerator that is capable of increasing a heat efficiency by preventing a cooling air loss occurring near a refrigerator door and capable of preventing a weak cooling of foodstuffs stored near the refrigerator door.

Still another object of the present invention is to provide a cooling air passage apparatus of a refrigerator that is capable of widely obtaining a storage space in a storage chamber.

To achieve these and other advantages and in accordance with the purpose of the present invention, as embodied and broadly described herein, there is provided a cooling air passage apparatus of a refrigerator including: a left cooling air duct installed having a plurality of cooling air discharge holes in the vertical direction at the left side of the opened marginal portion of an inner case forming a storage chamber, and discharging cooling air from the left side of the storage chamber toward a refrigerator door; a right cooling air duct installed having a plurality of cooling air discharge holes in the vertical direction at the right side of the opened marginal portion of the inner case, and discharging cooling air from the right side of the storage chamber toward the refrigerator door; a ventilating unit for ventilating cooling air generated from a freezing system to the storage chamber; and a diverging unit for diverging and guiding cooling air ventilated by the ventilating unit to the left cooling air duct and the right cooling air duct.

In the cooling air passage apparatus of a refrigerator of the present invention, the left cooling air duct is formed at a left enlarged portion of the inner case to guide cooling air in the vertical direction, and includes a first duct cover mounted at one side thereof, the first duct cover having a plurality of first cooling air discharge holes for discharging cooling air from the left side of the storage chamber.

In the cooling air passage apparatus of a refrigerator of the present invention, the right cooling air duct is formed at a right enlarged portion of the inner case to guide cooling air in the vertical direction, and includes a second duct cover mounted at one side thereof, the second duct cover having a plurality of second cooling air discharge holes for discharging cooling air from the right side of the storage chamber.

In the cooling air passage apparatus of a refrigerator of the present invention, the first and the second duct covers are formed with their section bent at a right angle, and protrusively formed with a certain width at the enlarged portion of the inner case to block a space between the door liner and the enlarged portion of the inner case.

In the cooling air passage apparatus of a refrigerator of the present invention, the first and the second duct covers are formed in a square form protruded with a certain width from the left side and the right side of the inner case in the inward direction, the protruded one side blocks the space between the door liner and the enlarged portion of the inner case, and the plurality of cooling air discharge holes are formed in the longitudinal direction.

In the cooling air passage apparatus of a refrigerator of the present invention, the diverging unit is formed at the upper inner side of the inner case, and includes a supply passage through which cooling air flows in from the freezing system, a left diverging passage connected between the supply passage and the left cooling air duct and supplying cooling air to the left cooling air duct, and a right diverging passage connected between the supply passage and the right cooling air duct and supplying cooling air to the right cooling air duct.

To achieve the above objects, there is further provided a cooling air passage apparatus of a refrigerator including: a left cooling air duct installed having a plurality of cooling air discharge holes in the vertical direction at the left side of the opened marginal portion of an inner case forming a storage chamber, and discharging cooling air from the left side of the storage chamber toward a refrigerator door; a right cooling air duct installed having a plurality of cooling air discharge holes in the vertical direction at the right side of the opened marginal portion of the inner case, and discharging cooling air from the right side of the storage chamber toward the refrigerator door; a door cooling air duct installed at the refrigerator door, for receiving cooling air from the left cooling air duct or the right cooling air duct and discharging the cooling air toward the refrigerator door; a ventilating unit for ventilating cooling air generated from a freezing system to the storage chamber; and a diverging unit for diverging and guiding cooling air ventilated by the ventilating unit to the left cooling air duct and the right cooling air duct.

The cooling air passage apparatus of a refrigerator of the present invention further includes a switching valve installed between the right cooling air duct and the door cooling air duct, for switching on or off cooling air flow from the right cooling air duct to the door cooling air duct.

In the cooling air passage apparatus of a refrigerator of the present invention, a discharge passage for supplying cooling air to the door cooling air duct is formed at either the left cooling air duct or the right cooling air duct.

In the cooling air passage apparatus of a refrigerator of the present invention, the door cooling air duct is installed in the horizontal direction at one side of the refrigerator door, a plurality of fourth cooling air discharge holes are formed to discharge cooling air in the longitudinal direction therof, and a supply passage is formed at one side thereof, being connected to the discharge passage formed at the right cooling air duct.

In the cooling air passage apparatus of a refrigerator of the present invention, the switching valve includes: a rotational rod rotatably hinged at the lower side of the discharge passage of the right cooling air duct; a switching shutter mounted at one side of the rotational rod, being rotated together with the rotational road to open and close the discharge passage; and a switching handle mounted at the end portion of the rotational rod, for rotating the rotational rod so that a user may open or close the discharge passage.

In the cooling air passage apparatus of a refrigerator of the present invention, the switching shutter is in a disk form having a diameter larger than that of the discharge passage.

The cooling air passage apparatus of a refrigerator of the present invention further includes: a suction duct installed at both sides of the rear sides of the left and right cooling air ducts of the inner case and having a plurality of cooling air suction holes for sucking cooling air by each space; and a barrier having a cooling air suction passage for moving cooling air of the storage chamber sucked through the suction duct toward an evaporation chamber.

To achieve the above objects, there is further provided a cooling air passage apparatus of a refrigerator including: a left cooling air duct installed having a plurality of cooling air discharge holes in the vertical direction at the left side of the opened marginal portion of an inner case forming a storage chamber, and discharging cooling air from the left side of the storage chamber toward a refrigerator door; a right cooling air duct installed having a plurality of cooling air discharge holes in the vertical direction at the right side of the opened marginal portion of the inner case, and discharging cooling air from the right side of the storage chamber toward the refrigerator door; a door cooling air duct installed at the refrigerator door, for receiving cooling air from the left cooling air duct or the right cooling air duct and discharging the cooling air toward the refrigerator door; a rear cooling air duct installed at the rear side of the inner case, having a plurality of cooling air discharge holes and discharging cooling air from the rear side of the storage chamber toward the door; a ventilating unit for ventilating cooling air generated from a freezing system to the storage chamber; and a diverging unit for diverging and guiding cooling air ventilated by the ventilating unit to the left cooling air duct and the right cooling air duct.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A cooling air passage of a refrigerator in accordance with the present invention will now be described with reference to the accompanying drawings.

A plurality of embodiments of the cooling air passage of a refrigerator in accordance with the present invention may exist, of which a preferred one will now be described.

Figure 1:
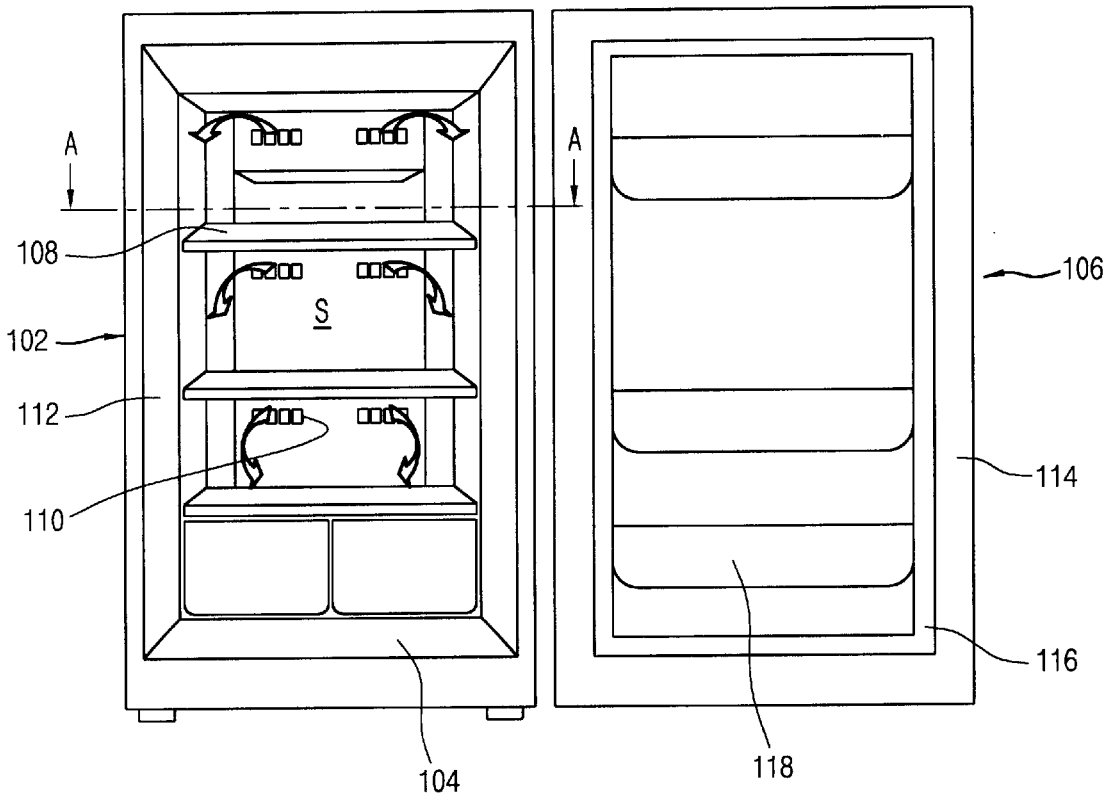
FIG. 1 is a front view showing a state that a door of a refrigerator is opened in accordance with a conventional art.
Figure 2:
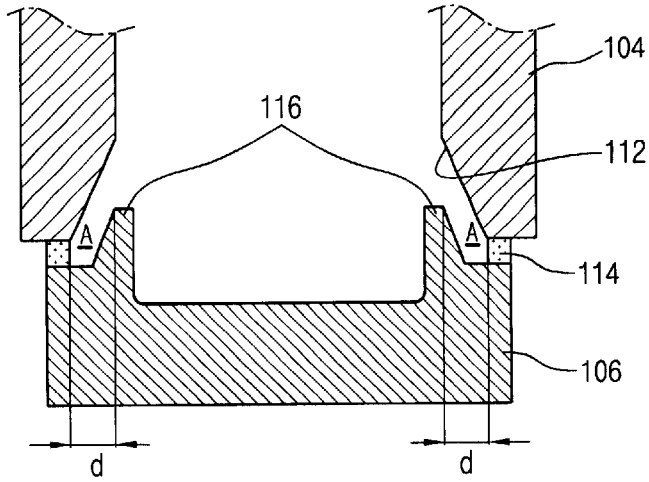
FIG. 2 is a sectional view taken along line 'A—A' of FIG. 1.
Figure 3:
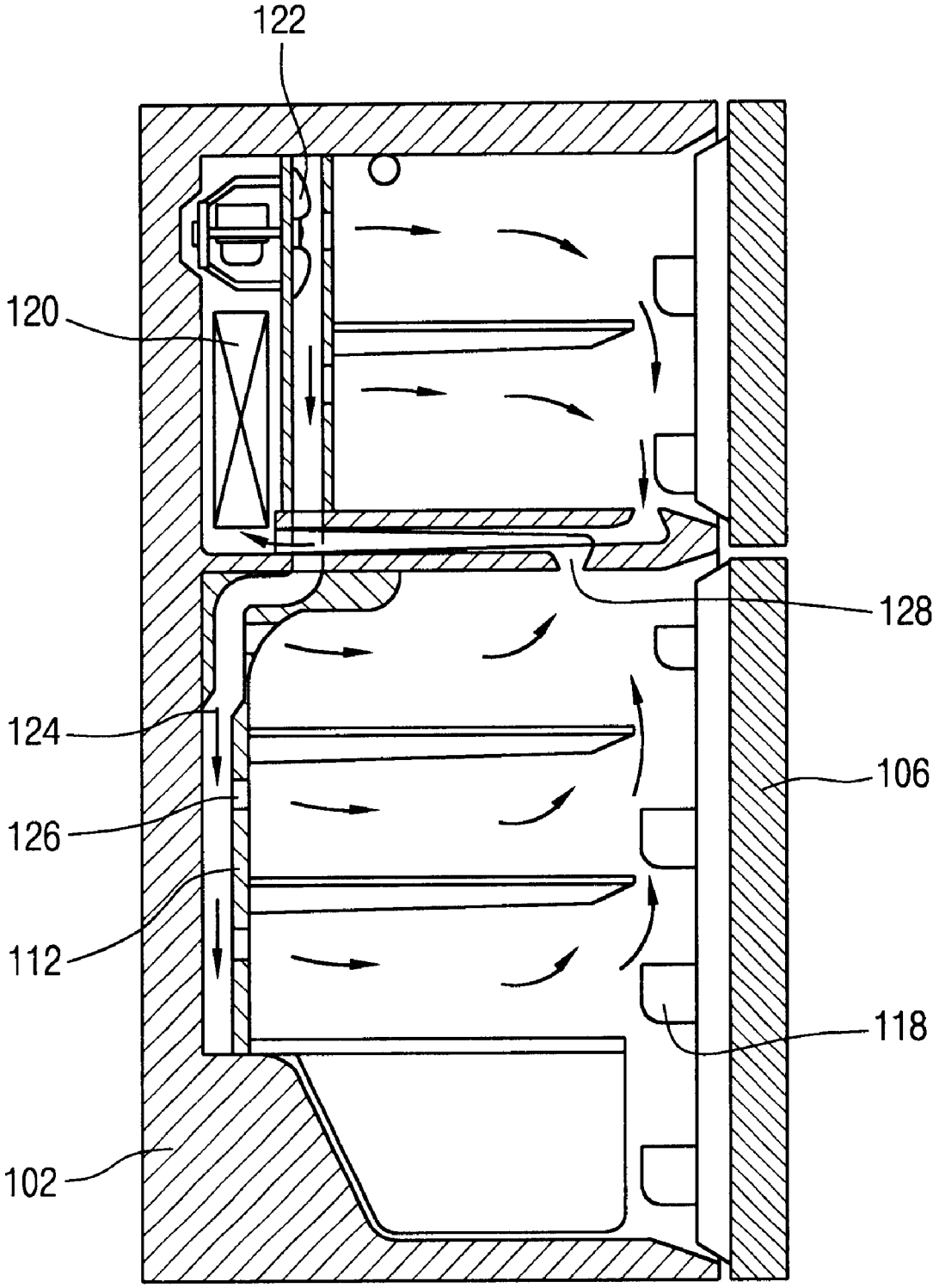
FIG. 3 is a vertical-sectional view showing a cooling air passage of the refrigerator in accordance with the conventional art.
Figure 4:
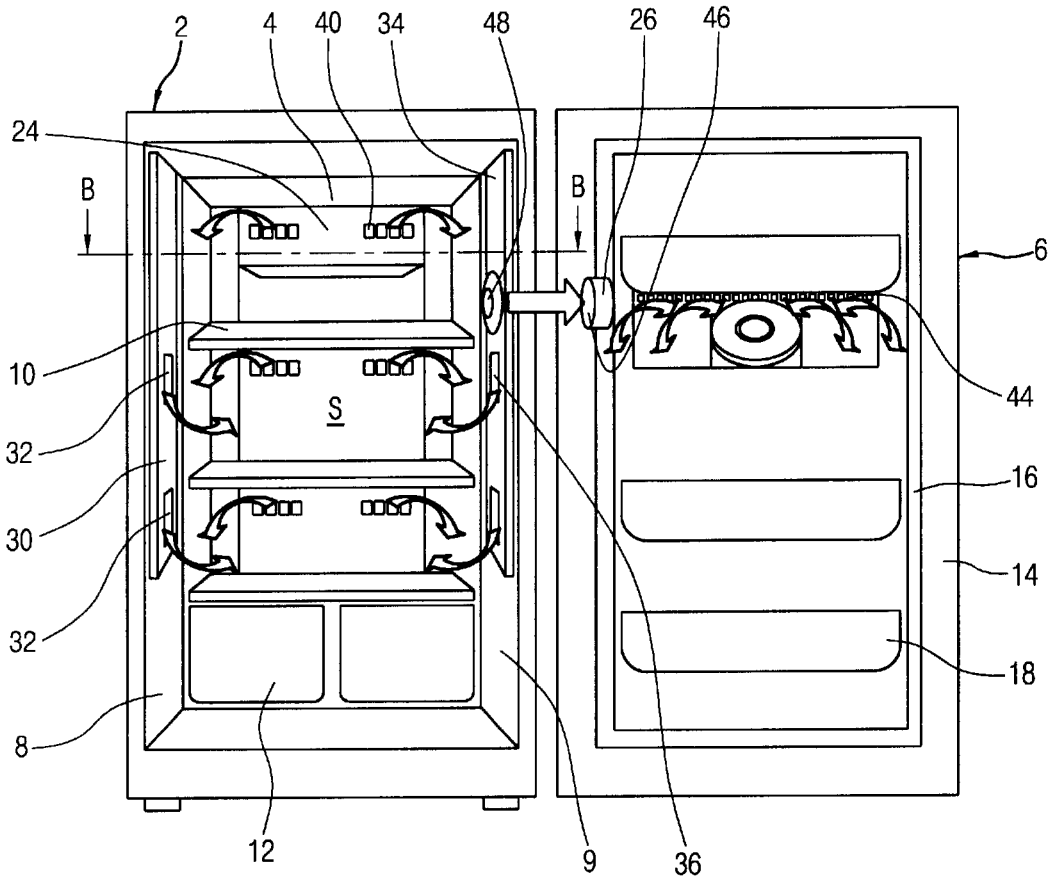
FIG. 4 is a front view showing a state that a door of a refrigerator is opened in accordance with a first embodiment of the present invention.
Figure 5:
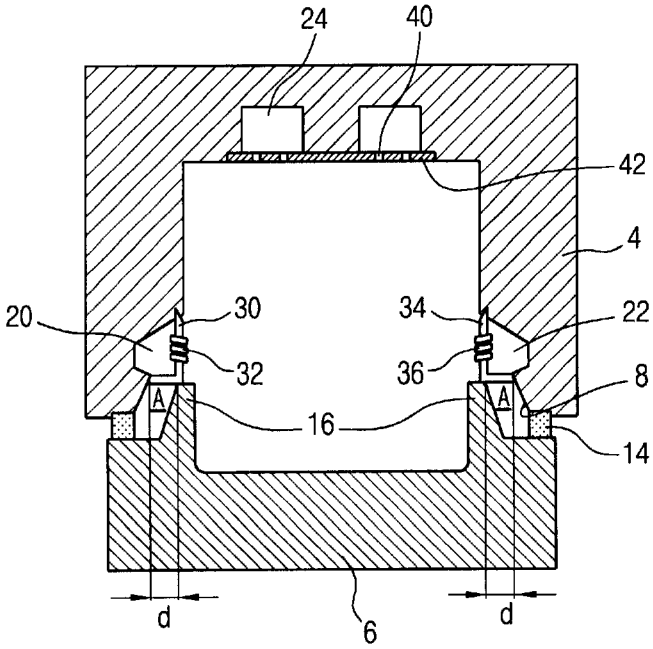
FIG. 5 is a sectional view taken along line 'B—B' of FIG. 4 in accordance with the first embodiment of the present invention.

FIG. 4 is a front view showing a state that a door of a refrigerator is opened in accordance with a first embodiment of the present invention, and FIG. 5 is a sectional view taken along line 'B—B' of FIG. 4 in accordance with the first embodiment of the present invention.

A refrigerator of the present invention includes: an outer case forming an outward show; an inner case disposed inside the outer case, forming a storage chamber (S); a door 6 mounted to be opened and closed at an opening portion of the inner case 4, for opening and closing the storage chamber; a freezing system (not shown) for cooling air inside the storage chamber (S); and a cooling air passage apparatus installed at both sides and the rear side of the inner case 4, for supplying air cooled by the freezing system to the storage chamber (S).

Enlarged portions 8 and 9 being widened slantingly are formed at the circumferential face of the opened front side of the inner case 4, and shelves 10 for partitioning the storage space into which foodstuffs are received are installed in the horizontal direction at both faces.

A vegetable chamber 12 is installed to receive vegetable and keep it freshly at the lower side of the inner case 4.

The refrigerator door 6 forms the storage chamber (S) together with the inner case 8, and a gasket 14 made of rubber is installed around the marginal portion to seal the storage chamber (S) when the refrigerator door 6 is closed.

A door liner 16 is formed in the circumferential direction at the inner side of the gasket 14, and door baskets 18 for receiving foodstuffs are installed by multistage at the door liner 16.

The cooling air passage apparatus includes: a left cooling air duct 20 and a right cooling air duct 22 being installed at left side and right side of the inner case 4, for discharging air which has been cooled while passing through the freezing system from left side and right side, respectively; a ventilating unit for ventilating air cooled by the freezing system to the left cooling air duct 20 and the right cooling air duct 22; and a diverging unit for diverging air ventilated by the ventilating unit to the left cooling air duct and the right cooling air duct.

A rear cooling air duct 24 is installed at the rear side of the inner case 4 to discharge cooling air from the rear side of the storage chamber (S), and a door cooling air duct is installed at the door 6 to discharge cooling air toward the door.

A switching valve 28 is installed between the right cooling air duct 22 and the door cooling air duct 26 for switching on or off a cooling air flow from the right cooling air duct 22 to the door cooling air duct 26.

The left cooling air duct 20 is formed in the vertical direction at the left enlarged portion 8 of the inner case, to guide cooling air, and a first duct cover 30 is coupled at one side thereof, forming a cooling air passage.

A plurality of first cooling air discharge holes 32 for discharging cooling air from the left side of each space partitioned by the shelves in the longitudinal direction are formed at the first duct cover 30.

The right cooling air duct 22 is formed in the vertical direction at the right enlarged portion 9 of the inner case 4, to guide cooling air, and a second duct cover 34 is coupled at one side thereof, forming a cooling air passage.

A plurality of second cooling air discharge holes 36 for discharging cooling air from the right side of each space partitioned by the shelves 10 are formed at the second duct cover 34.

As mentioned above, the first duct cover 30 and the second duct cover 34 constitute a cooling air passage, include the cooling air discharge holes 32 and 36, and prevents cooling air from contacting with the gasket 14 of the refrigerator door.

In other words, as shown in FIG. 5, the first and the second duct covers 30 and 34 are protruded vertically as much as the width (d) from the enlarged portions 8 and 9 of the inner case, to block a space portion (A) formed between the door liner 16 and the inner case 4, thereby isolating it from the storage chamber (S).

In detail, when the door 6 is closed, the space portion (A) is formed between the door liner 16 and the enlarged portion 8. When cooling air is introduced into the space portion (A), cooling air contacts the gasket 14. Then, the external heat is transmitted into the storage chamber (S) through the gasket 14 which is relatively weak to insulation. At this time, the protruded portion of the first and the second duct covers 30 and 34 block the space portion (A), thereby preventing cooling air of the storage chamber (S) from being introduced into the space portion (A).

It is preferred that the ventilating unit is a ventilating fan which is installed at the passage of the inner case and ventilates cooling air generated by the freezing system to each cooling duct.

Figure 6:
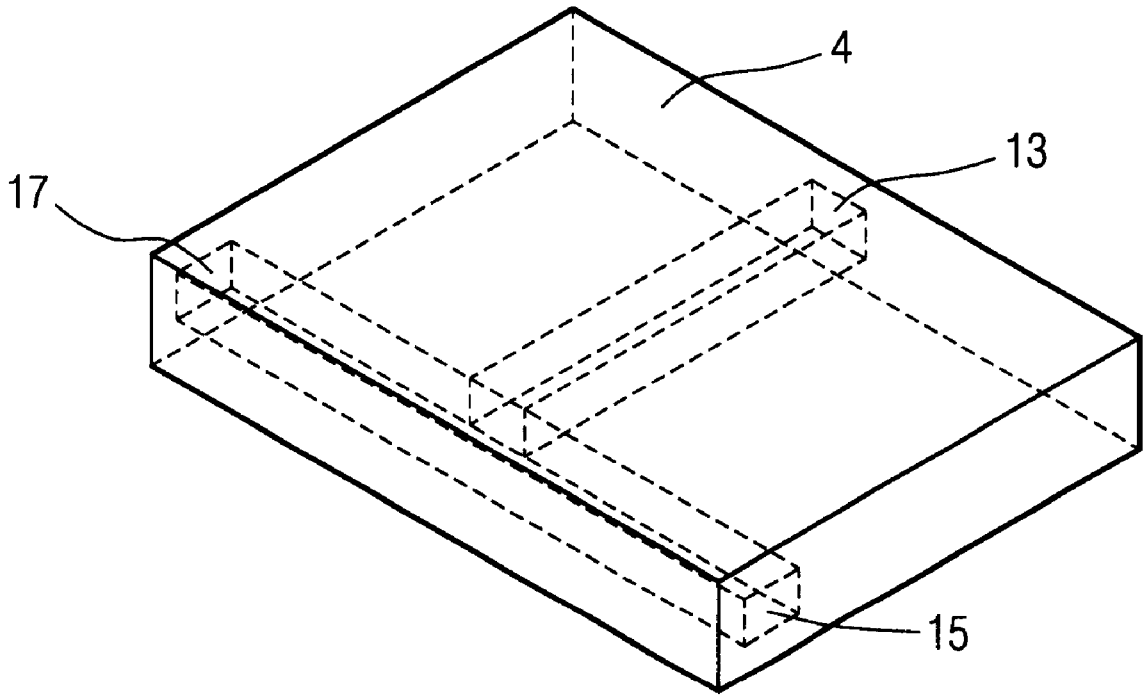
FIG. 6 is a perspective view showing a cooling air passage of the refrigerator in accordance with the first embodiment of the present invention.

As shown in FIG. 6, the diverging unit is formed at an upper side of the inner case 4 and includes a supply passage 13 to which cooling air flows after being generated from the freezing system; a left separating passage 17 being connected to the supply passage 13, for supplying cooling air to the left cooling air duct 20; and a right separating passage 15 being connected to the supply passage 13, for supplying cooling air to the right cooling air duct 22.

The rear discharge duct 24 is formed in the vertical direction at the rear side of the inner case 4, through which cooling air is supplied from the freezing system, and a third duct cover 42 is mounted at the front side, having a plurality of third cooling air discharge holes 40 for discharging cooling air into the storage chamber (S).

The third duct cover 42 is coupled in a manner of being inserted into the inner case 4, making the same plane with the rear face of the inner case 4.

The door cooling air duct 26 is installed in the horizontal direction at one side of the refrigerator door 6. A plurality of fourth cooling air discharge holes 44 for discharging cooling air to the door 6 in the longitudinal direction are formed, and a supply passage 46 is formed at one side, to which cooling air flows in.

When the refrigerator door 6 is closed, the supply passage 46 is closely attached to a discharge passage 48 formed at the second duct cover 34, through which the supply passage receives cooling air from the right discharge duct 22.

Figure 7:
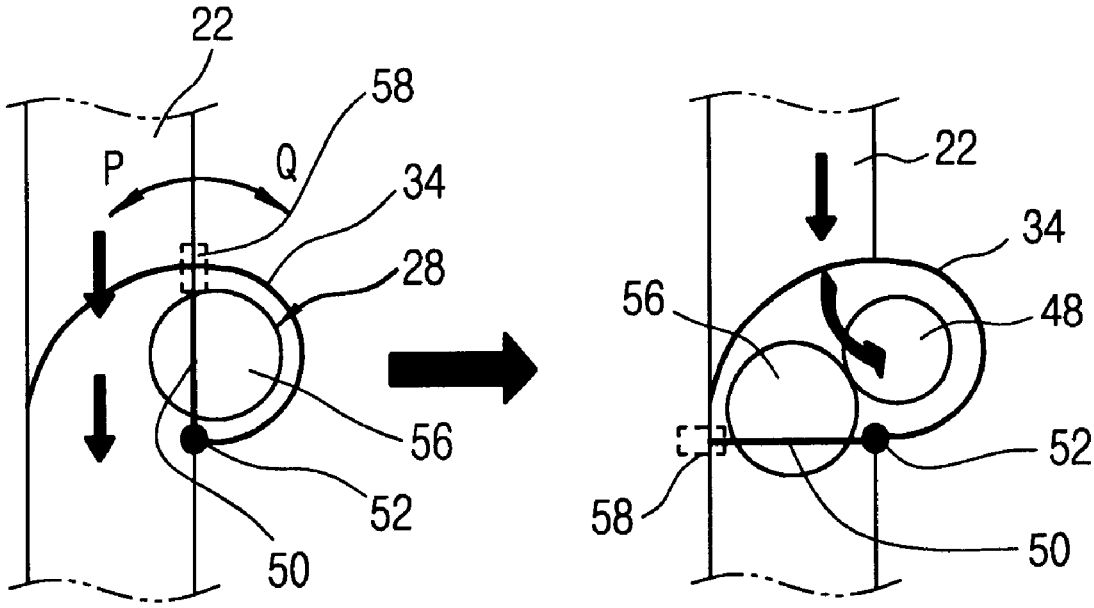
FIG. 7 is sectional view showing portions of a switching valve in accordance with the first embodiment of the present invention.

As shown in FIG. 7, the switching valve 28 for switching on or off a cooling air flow from the right cooling air duct 22 to the door cooling air duct 6 includes a rotational rod 50 for rotatably hinged at one side of the second duct cover 34 where the discharge passage 48 is formed; a switching shutter 56 mounted at one side of the rotational rod 50, for opening and closing the discharge passage 48 while being rotated together with the rotational rod 50; and a switching handle 58 mounted at an end portion of the rotational rod 50 so that a user may rotate the rotational rod 50 to open or close the discharge passage 48.

The switching shutter 56 is in a disk form having a diameter larger than that of the discharge passage 48.

In case where cooling air is desired to be supplied to the refrigerator door, the switching handle 58 of the switching valve 48 is rotated in the 'P' direction In FIG. 7. Then, the rotational rod 50 is rotated centering around a hinge 52, according to which the switching shutter 56 mounted at the rotational rod 50 is also rotated, thereby opening the discharge passage 48.

On the other hand, in case where cooling air is desired to be cut off from being supplied to the door, the switching handle 58 is rotated in the 'Q' direction in FIG. 7, so that the switching shutter 56 closes the discharge passage 48.

The operation of the cooling air passage apparatus of a refrigerator in accordance with a preferred embodiment of the present invention constructed as described above will now be explained.

When the freezing system is driven, the air inside the storage chamber (S) is cooled while passing the freezing system. The cooling air is then supplied to each portion of the storage chamber (S) through the cooling air passage apparatus, lowering the temperature of the storage chamber (S).

The air cooled while passing the freezing system is supplied through the left cooling air duct 20 to the left side of the storage chamber (S), supplied through the right cooling air duct 22 to the right side of the storage chamber (S), and also supplied from the rear side of the storage chamber (S) through the rear cooling air duct 24.

When the switching valve 28 is operated in the direction of opening the discharge passage 48, cooling air is introduced into the door cooling air duct 26, so that cooling air is supplied to the door 6 to cool the whole storage chamber (S) uniformly and quickly.

In more detail, cooling air introduced into the left and right cooling air ducts 20 and 22 are concentratedly supplied to the front end portion and the left and right marginal portions of the shelves 10 while being discharged through the first and the second cooling air discharge holes 32 and 36, thereby making a uniform and rapid cooling.

The left and right cooling air ducts 20 and 22 are formed protruded in the right angle direction at the front side of the first and the second duct covers 30 and 34 installed at the left and the right enlarged portions 8 and 9. Thus, in a state that the door 6 is closed, the space formed between the door liner 16 and the enlarged portions 8 and 9 is clogged, preventing cooling air from contacting with the gasket 14, thereby preventing cooling air loss.

Cooling air supplied to the rear cooling air duct 26 is discharged through the third cooling air discharge hole 40, thereby promptly cooling the rear side of the storage chamber (S).

When the switching valve 28 is operated to supply cooling air to the door cooling air duct 26, the cooling air is discharged through the fourth cooling air discharge hole 44 to the door 6, so that the foodstuffs stored in the door basket 18 is cooled.

The operation of the switching valve will now be described in more detail.

In case that cooling is desired to be supplied toward the door 6, when the user rotates the switching handle 58 in one direction, the rotational rod 50 is rotated centering around the hinge 52. Then, the switching shutter 56 mounted at the rotational rod 50 is accordingly rotated to pen the discharge passage.

On the other hand, in case that cooling air is desired to be cut off from being supplied to the door 6, when the user rotates the switching handle 58 in the other direction, the switching shutter 56 closes the discharge passage 48.

The user may adjust the amount of cooling air supplied to the door 6 by controlling the rotation degree of the switching shutter 56, that is, the rotational angle of the rotational rod 50.

Namely, in case that there are many foodstuffs in the door basket 18 or in case that much load is applied to the door such as in the summer season when the door 6 is frequently opened, the switching valve 28 is completely opened so that the foodstuffs stored in the door basket 18 can be quickly cooled.

Meanwhile, if the door is not much loaded, the switching valve is opened in a certain range. Otherwise, if there is no load to the door, the switching valve is closed to cut off cooling air from being supplied to the door.

In this manner, since cooling air is discharged from the both sides, rear side and the front side of the storage chamber, cooling air is evenly supplied to the every part of the storage chamber and the storage chamber is promptly cooled.

Figure 8:
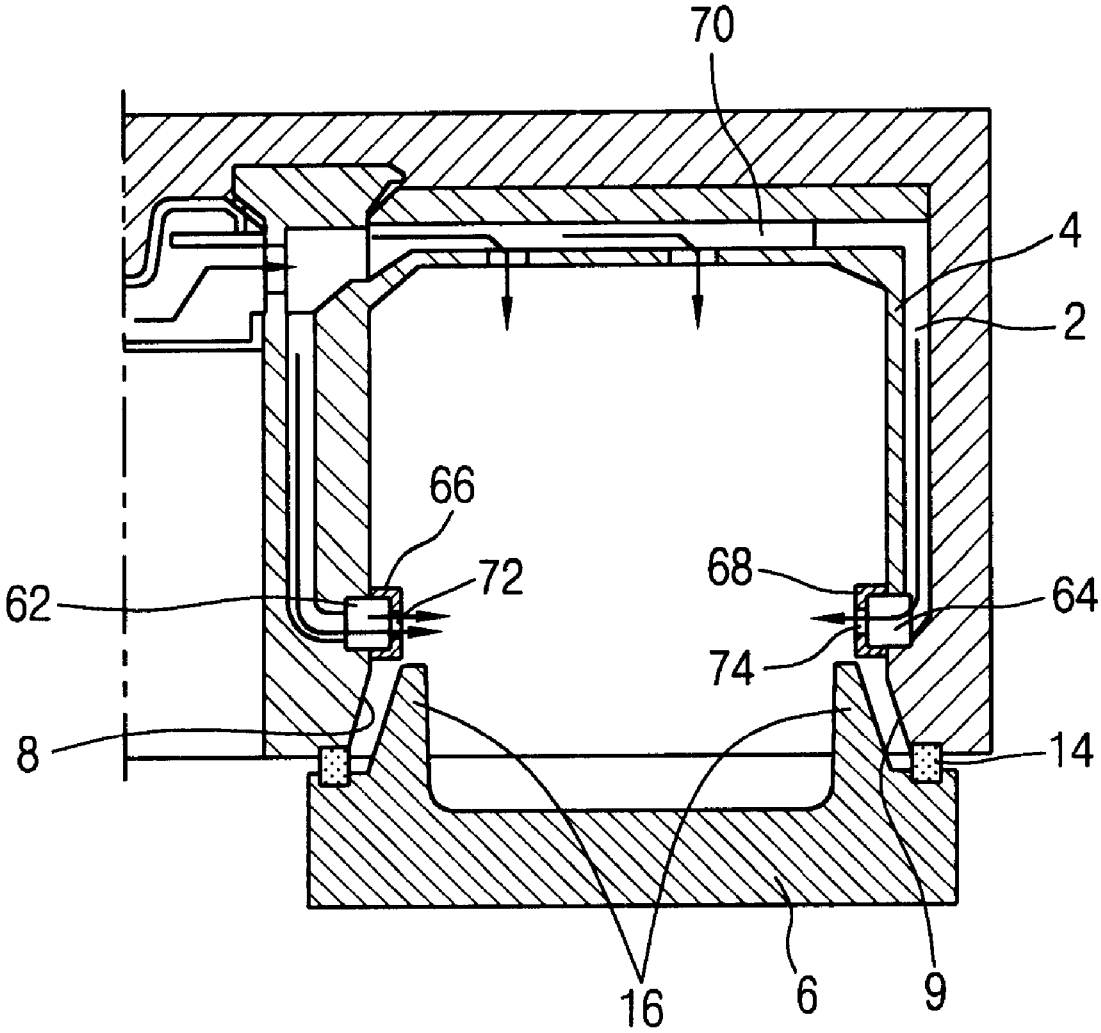
FIG. 8 is a sectional view taken along line 'B—B' of FIG. 4 in accordance with a second embodiment of the present invention.

FIG. 8 is a sectional view taken along line 'B—B' of FIG. 4 in accordance with a second embodiment of the present invention.

A cooling air passage apparatus of a refrigerator in accordance with a second embodiment of the present invention includes: left and right cooling air ducts 62 and 64 formed respectively at both sides of the inner case 4, for discharging cooling air from left and right side of the storage chamber (S); and a rear cooling air duct 70 installed at the rear side of the inner case 4, for discharging cooling air from the rear side of the storage chamber (S).

Duct covers 66 and 68 are installed at the left and right cooling air ducts 62 and 64 and cooling air discharge holes 72 and 74 are formed at the duct covers 66 and 68, for discharging cooling air.

That is, the protruded portion of the duct covers 66 and 68 blocks the space between the door liner 80 and the enlarged portions 6 and 8, preventing cooling from flowing into the space. Thus, in a state that the door 6 is closed, cooling air of the storage chamber is cut off from flowing into the space between the door liner 16 and the enlarged portions 8 and 9 of the inner case, so that cooling air is prevented from contacting with the gasket 14.

Figure 9:
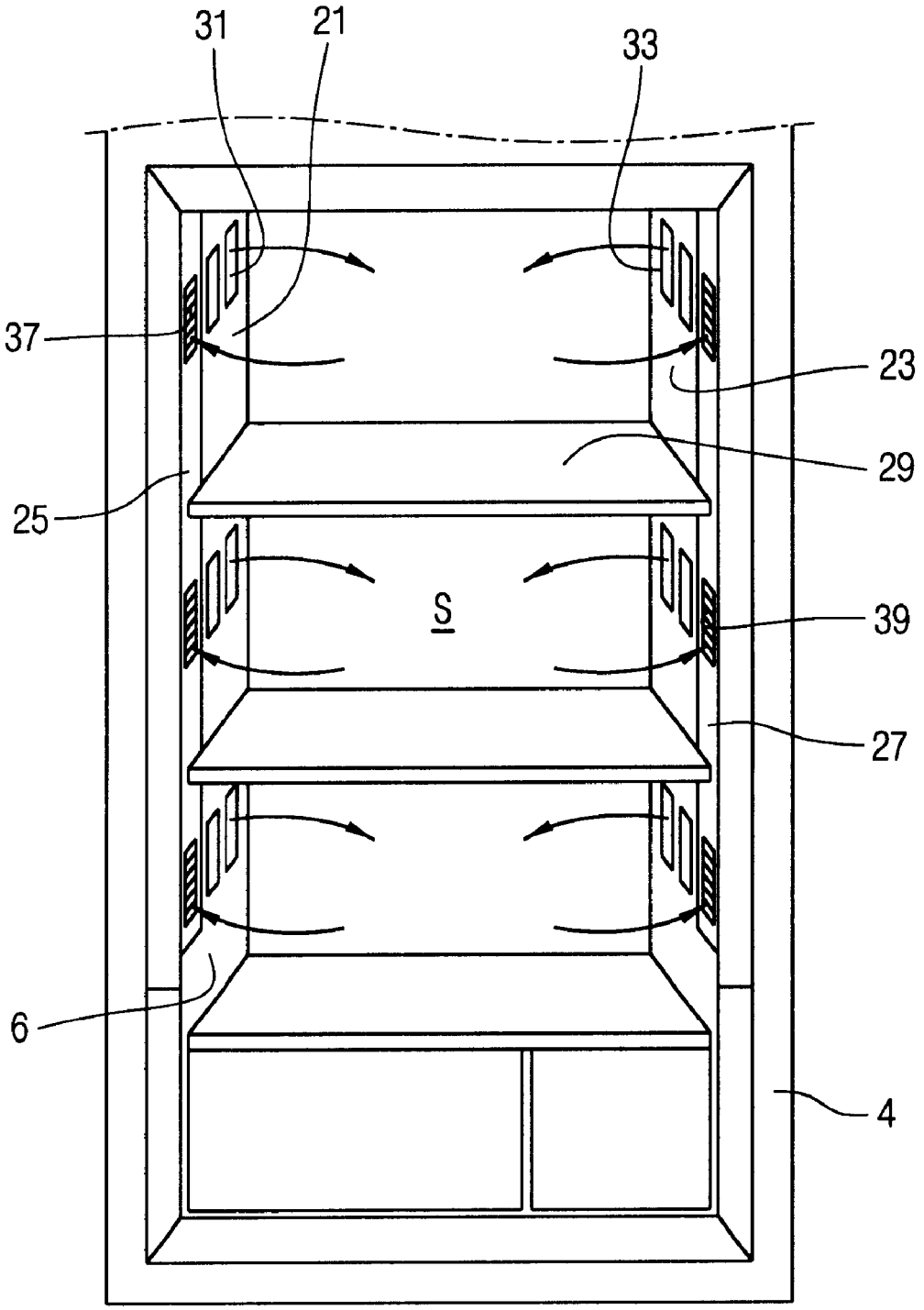
FIG. 9 is a front view showing a state that a door of a refrigerator is opened in accordance with a third embodiment of the present invention.
Figure 10:
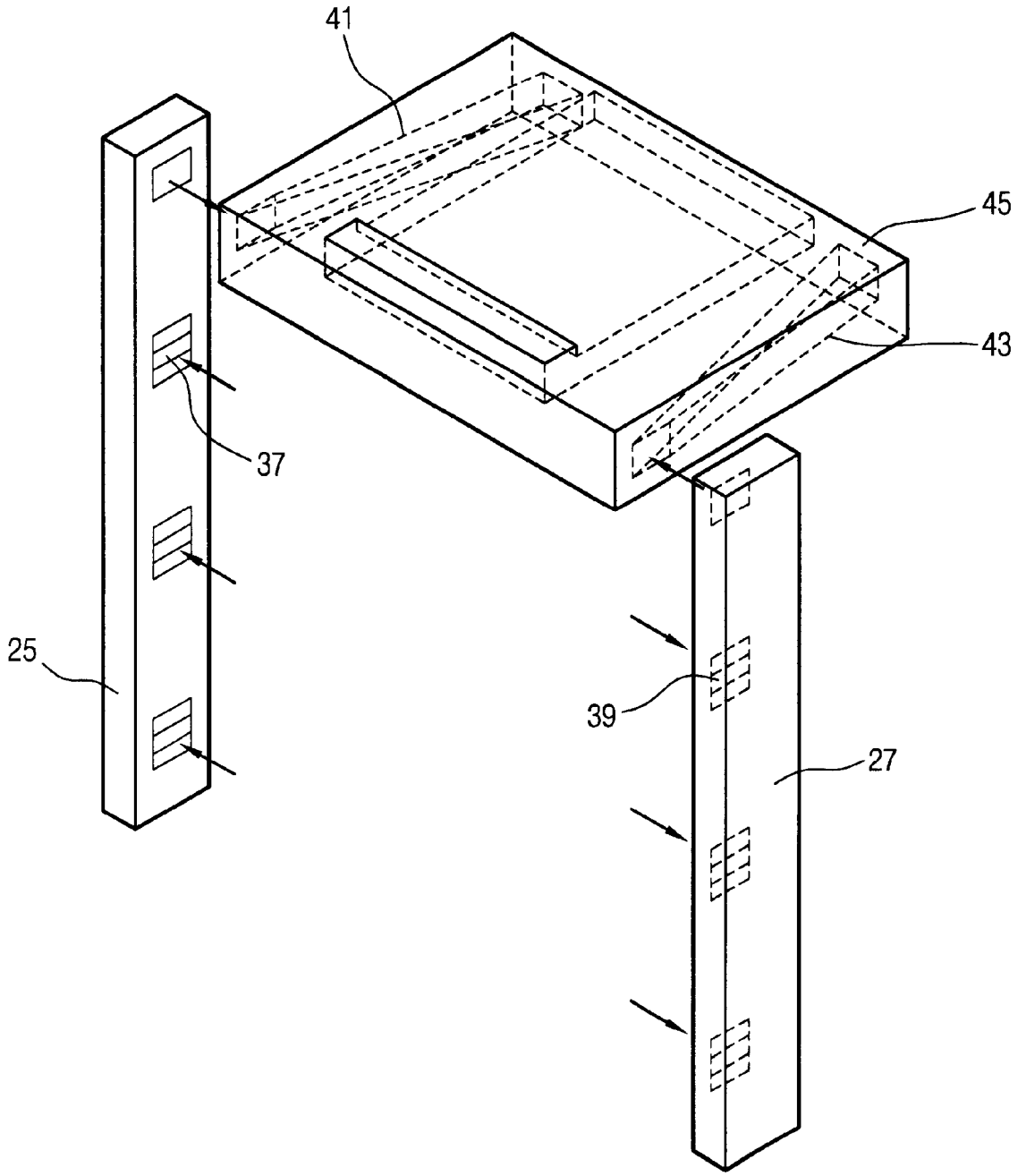
FIG. 10 is a perspective view showing a suction duct and barriers of the refrigerator in accordance with the third embodiment of the present invention.

FIG. 9 is a front view showing a state that a door of a refrigerator is opened in accordance with a third embodiment of the present invention, and FIG. 10 is a perspective view showing a suction duct and barriers of the refrigerator in accordance with the third embodiment of the present invention.

The refrigerator in accordance with the third embodiment of the present invention includes: an outer case 4 forming an outward show, an inner case 6 forming a storage chamber (S) for storing foodstuffs, a door for opening and closing the storage chamber, a freezing system installed at one side of the inner case, for generating cooling air, and a cooling air passage apparatus for supplying cooling air generated by the freezing system to the storage chamber (S) through the rear side or both sides of the storage chamber (S).

The cooling air passage apparatus includes first and second discharge ducts 21 and 23 installed at both wall faces of the inner case 6, for supplying air cooled while passing an evaporator of the freezing system to the storage chamber (S); and first and second discharge ducts 25 and 27 installed at front sides of both wall faces of the inner case 6, for sucking air which has been cooled after being supplied through the first and the second discharge ducts 21 and 23 and circulated to the storage chamber (S).

The first and second discharge ducts 21 and 23 are respectively installed at rear sides of the left and right wall faces of the inner case 6, and cooling air discharge holes 31 and 33 are formed corresponding to each space so as to supply cooling air to every space partitioned by the shelves 29.

As shown in FIG. 9, the first and the second suction ducts 25 and 27 are horizontally disposed at the front side of the first and the second discharge ducts 21 and 23, and cooling air suction holes 37 and 39 are formed corresponding to each space so that cooling air can be sucked from both left and right sides by each space partitioned by the shelves 29.

A barrier 45 is installed at the upper portion of the first and the second suction ducts 25 and 27 and has cooling air suction passages 41 and 43 for moving cooling air sucked through the suction duct to the freezing system.

That is, the cooling air suction passages 41 and 43 of the barrier and the first and the second suction ducts 25 and 27 are connected to each other, so that cooling air introduced through the first and second suction ducts 25 and 27 flows into the cooling air suction passage and is guided to the freezing system.

The operation of the cooling air passage apparatus of a refrigerator in accordance with the third embodiment of the present invention constructed as described above will now be explained.

Air inside the storage chamber passes through the freezing system and is cooled, and the cooled air is moved to the first and the second discharge ducts 21 and 23.

Thereafter, the cooling air moved to the first and the second discharge ducts 21 and 23 is moved downwardly along the first and the second discharge ducts 21 and 23 and discharged into the storage chamber from the left and right side of the inner case 6 through the plurality of cooling air discharge holes 31 and 33 formed by each space of the storage chamber (S).

In this manner, the cooling air discharged into the storage chamber is circulated to cool the storage chamber (S) and sucked into the suction ducts 25 and 27 through the cooling air suction holes 37 and 39 respectively formed at both wall faces of the inner case 6.

Thereafter, the cooling air sucked into the suction ducts 25 and 27 is moved upwardly along the suction ducts 25 and 27, introduced into the barrier 45 and supplied to the freezing system along the cooling air suction passages 41 and 43, so that air cooling is again performed.

Accordingly, since cooling air is charged from the left and right sides and the rear side of the storage chamber and sucked to the left and right sides of the storage chamber, cooling air can be quickly and evenly supplied to every part of the storage chamber.

Therefore, the temperature distribution in the storage chamber is uniformly maintained, and thus, foodstuffs are prevented from over-cooling or weak-cooing due to a temperature deviation.

In addition, since the cooling speed of the storage chamber is improved and thus a load inputted in the storage chamber can be promptly cooled, foodstuffs can be prevented from being damaged possibly due to a rise in the temperature at the summer season when the refrigerator door is frequently opened.

As so far described, the cooling air passage apparatus of a refrigerator in accordance with the present invention has many advantages.

For example, first, since the left and right cooling air ducts are installed at left side and right side of the inner case, a rear cooling air discharge duct is installed at the rear face of the inner case, and a door cooling air duct is installed at the door, to discharge cooling air from the front, rear, left and right side of the storage chamber, the temperature distribution of the storage chamber can be uniformly maintained, and when a load is inputted into the storage chamber, a load can be quickly cooled.

Secondly, since the left and right duct cover forming the left and right cooling air duct are formed protruded with a certain width in the inward direction of the inner case, the protruded face blocks the space between the door liner and the enlarged portions of the inner case. Thus, a cooling air loss generated near the door is prevented and a heat efficiency can be increased. Also, the foodstuffs stored near the door can be prevented from weakly cooling.

Lastly, since cooling air of the inner case is discharged from the front, rear, left and right side of the storage chamber, the size of each cooling air discharge duct can be reduced, and accordingly, the storage space inside the storage chamber can be more widely obtained.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A cooling air passage apparatus of a refrigerator, comprising:

a left cooling air duct having a plurality of cooling air discharge holes located at the left side of an opened marginal portion of an inner case forming a storage chamber, and configured to discharge cooling air from the left side of the storage chamber;

a right cooling air duct having a plurality of cooling air discharge holes located at the right side of the opened marginal portion of the inner case, and configured to discharge cooling air from the right side of the storage chamber;

a door cooling air duct installed in a door of the refrigerator and configured to receive cooling air from the left cooling air duct or the right cooling air duct;

a ventilating unit for ventilating cooling air generated from a freezing system to the storage chamber; and a diverging unit for diverging and guiding cooling air ventilated by the ventilating unit to the left cooling air duct and the right cooling air duct.

2. The apparatus of claim 1, further comprising a switching valve installed adjacent the door cooling air duct and configured to control a cooling air flow from one of the tight cooling air duct and the left cooling air duct into the door cooling air duct.

3. The apparatus of claim 1, wherein a discharge passage for supplying cooling air to the door cooling air duct is formed at either the left cooling air duct or the right cooling air duct.

4. The apparatus of claim 1, wherein the door cooling air duct is installed in the horizontal direction at one side of the refrigerator door, wherein a plurality of cooling air discharge holes are formed to discharge cooling air from the door cooling air duct and wherein the door cooling air duct is configured to be connected to one of the left and right cooling air ducts when the door is closed.

5. The apparatus of claim 2, wherein the switching valve comprises:

a rotational rod rotatably hinged at its lower side;

a switching shutter mounted at one side of the rotational rod, wherein the rotational rod and the switching shutter may be rotated together to control the flow of cooling air into the door cooling air duct; and a switching handle mounted at an end portion of the rotational rod, for rotating the rotational rod.

6. The apparatus of claim 5, wherein the switching shutter is in a disk form having a diameter larger than that of the door cooling air duct.

7. The apparatus of claim 1, further comprising:

left and right suction ducts installed adjacent the left and right cooling air ducts of the inner case and having a plurality of cooling air suction holes for sucking cooling air; and a barrier having a cooling air suction passage for moving cooling air from the storage chamber sucked through the left and right suction ducts toward an evaporation chamber.

8. A cooling air passage apparatus of a refrigerator, comprising:

a left cooling air duct having a plurality of cooling air discharge holes located at the left side of an opened marginal portion of an inner case forming a storage chamber, and configured to discharge cooling air from the left side of the storage chamber;

a right cooling air duct having a plurality of cooling air discharge holes located at the right side of the opened marginal portion of the inner case, and configured to discharge cooling air from the right side of the storage chamber;

a door cooling air duct installed in the refrigerator door, and configured to receive a flow of cooling air from the left cooling air duct or the right cooling air duct and to discharge the cooling air into the storage chamber;

a rear cooling air duct installed at a rear side of the inner case, and having a plurality of cooling air discharge holes configured to discharge cooling air from the rear side of the storage chamber;

a ventilating unit for ventilating cooling air generated from a freezing system to the storage chamber; and a diverging unit for diverging and guiding cooling air ventilated by the ventilating unit to the left cooling air duct and the right cooling air duct.

* * * * *